United States Patent [19]

Erdman

[11] Patent Number: 5,074,780

[45] Date of Patent: Dec. 24, 1991

[54] CONTROL SYSTEM FOR FORCED COMBUSTION AIR HEATING APPLIANCE

[75] Inventor: John L. Erdman, Eden Prairie, Minn.

[73] Assignee: Honeywell, Inc., Minneapolis, Minn.

[21] Appl. No.: 596,420

[22] Filed: Oct. 10, 1990

Related U.S. Application Data

[63] Continuation of Ser. No. 239,451, Sep. 1, 1988, abandoned.

[51] Int. Cl.[5] ..... F23N 5/00; F23N 5/24

[52] U.S. Cl. ..... 431/24; 431/18

[58] Field of Search ..... 431/6, 18, 24, 25, 26, 431/29, 31, 75

[56] References Cited

U.S. PATENT DOCUMENTS

| | | | |
|---|---|---|---|
| 4,298,334 | 11/1981 | Clark et al. | 431/24 |
| 4,399,537 | 8/1983 | Jones | 371/14 |
| 4,403,942 | 9/1983 | Copenhauser | 431/24 |
| 4,451,225 | 5/1984 | Landis et al. | 431/24 |
| 4,455,656 | 6/1984 | Tanaka et al. | 431/24 |
| 4,518,345 | 5/1985 | Mueller et al. | 431/24 |
| 4,581,697 | 4/1986 | Jamieson et al. | 364/140 |
| 4,604,046 | 8/1986 | Mueller et al. | 431/2 |
| 4,605,863 | 8/1986 | Toudo et al. | 307/269 |
| 4,842,510 | 6/1989 | Geunden et al. | 431/19 |
| 4,850,852 | 7/1989 | Ballard | 431/6 |

*Primary Examiner*—Carl D. Price

*Attorney, Agent, or Firm*—Kinney & Lange

[57] ABSTRACT

A control system, for a gas-fired, forced combustion air heating appliance, controls operation of a combustion air blower and a gas valve as a function of signals from a thermostat, a combustion air proving sensor switch, and a gas valve control relay. When the thermostat demands heat, the control system first checks the status of the combustion air sensor switch before starting the combustion air blower. If the combustion air sensor switch indicates that combustion air is being delivered before the combustion air blower has started, the control system immediately halts the ignition sequence. If the combustion air sensor switch is functioning properly, the ignition sequence continues and the control system checks the status of the contacts of the gas valve relay. If the relay contacts which power the gas valve are already closed before the gas valve relay coil is energized, the control system halts the ignition sequence by turning off the combustion air blower, causing the combustion air sensor switch to open and shut off power to the gas valve.

29 Claims, 3 Drawing Sheets

CONTROL SYSTEM FOR FORCED COMBUSTION AIR HEATING APPLIANCE

This is a continuation of application Ser. No. 07/239,451 filed on Sept. 1, 1988, abandoned as of the date of this application.

REFERENCE TO COPENDING APPLICATIONS

Reference is hereby made to my copending patent applications entitled "DIGITAL CONTROLLER COMPONENT FAILURE DETECTION FOR GAS APPLIANCE IGNITION FUNCTION", "SAFETY-RELATED PARAMETER INPUTS FOR MICROPROCESSOR IGNITION CONTROLLER", and "SPEED CONTROL FOR MULTITAP INDUCTION MOTOR" which are filed on even date with this application and are assigned to the same assignee.

BACKGROUND OF THE INVENTION

1. Field of the Invention

The present invention relates to ignition controls for gas-fired, forced combustion air heating appliances.

2. Description of the Prior Art

To obtain higher efficiency, many gas-fired furnaces use induced-draft combustion air blowers and electronic fuel ignition. A standard approach for this type of heating appliance has been to use the closure of the thermostat heat demand contacts to power a combustion air blower relay, which turns on the combustion air blower. The ignition control is then powered through a combustion air sensor (the "combustion air proving pressure switch"), which closes when the combustion air blower is delivering combustion air.

An important consideration for any gas-fired heating appliance is safety in the case of a failure of one or more of the components of the appliance and its ignition control system. For example, Underwriters Laboratory requirements for failure modes and effects analysis (FMEA) require that all single component failures either cause a safe shutdown of the appliance or, if undetected, the ignition control must continue to operate safely. If the ignition control continues to operate after a first order component failure, then for all combinations of second order failures, it must either continue to operate safely, or shutdown safely.

Two potential problems exist with the standard control system for an induced-draft forced combustion air furnace. First, most combustion air proving pressure switches have a single pole normally open (SPNO) contact configuration. A welded contact in the pressure switch is not detectable. This by itself may not pose a serious problem, since there are various other steps which must take place before ignition. However, if the combustion air blower also were to fail when the combustion air proving pressure switch has its normally open contacts welded closed, the ignition control would attempt ignition without a combustion air supply. This is a potentially unsafe condition.

Second, in those ignition control systems which have only a single relay controlling the gas valve, the welding shut of the normally open contacts of the gas valve control relay leaves the ignition control with no way to shut off the gas valve. While the drive circuit which controls the gas valve control relay may be failsafe, the welding of the relay contacts leaves the control of the gas valve solely to the operation of the thermostat heat demand contacts.

At the present time, these two potential problems are addressed by requiring that the pressure switch and the gas valve relay pass certain life test requirements. This, however, addresses the two potential problems in an indirect way, and does not provide for safe operation or shutdown in the event that one of these two components does, in fact, fail.

SUMMARY OF THE INVENTION

The present invention is an improved ignition control system for a gas-fired, forced combustion air heating appliance in which operation of the combustion air blower and the gas valve is controlled by a controller which monitors the status of the thermostat, the combustion air sensor, and the gas valve control relay.

When the thermostat demands heat, the controller checks the status of the combustion air pressure switch. The ignition sequence will not start unless the pressure switch contacts are proved open. If the pressure switch contacts are open, the controller then starts the combustion air blower and monitors the status of the pressure switch to ensure that the contacts then close. If they do not close, the ignition sequence again is halted.

Once the pressure switch contacts have closed, the controller checks the status of the gas valve control relay contacts before energizing the gas valve control relay. If welded contacts are detected by the controller, the controller halts the ignition sequence by turning off the combustion air blower, which thereby causes the pressure switch contacts to open and breaks the energization circuit for the gas valve.

With the present invention, therefore, the failure of either the pressure switch or the gas valve control relay by contact welding is detectable, and the ignition controller can halt the ignition sequence and shut off the gas supply in the event that a failure is detected.

DETAILED DESCRIPTION OF THE PREFERRED EMBODIMENTS

Figure 1A:
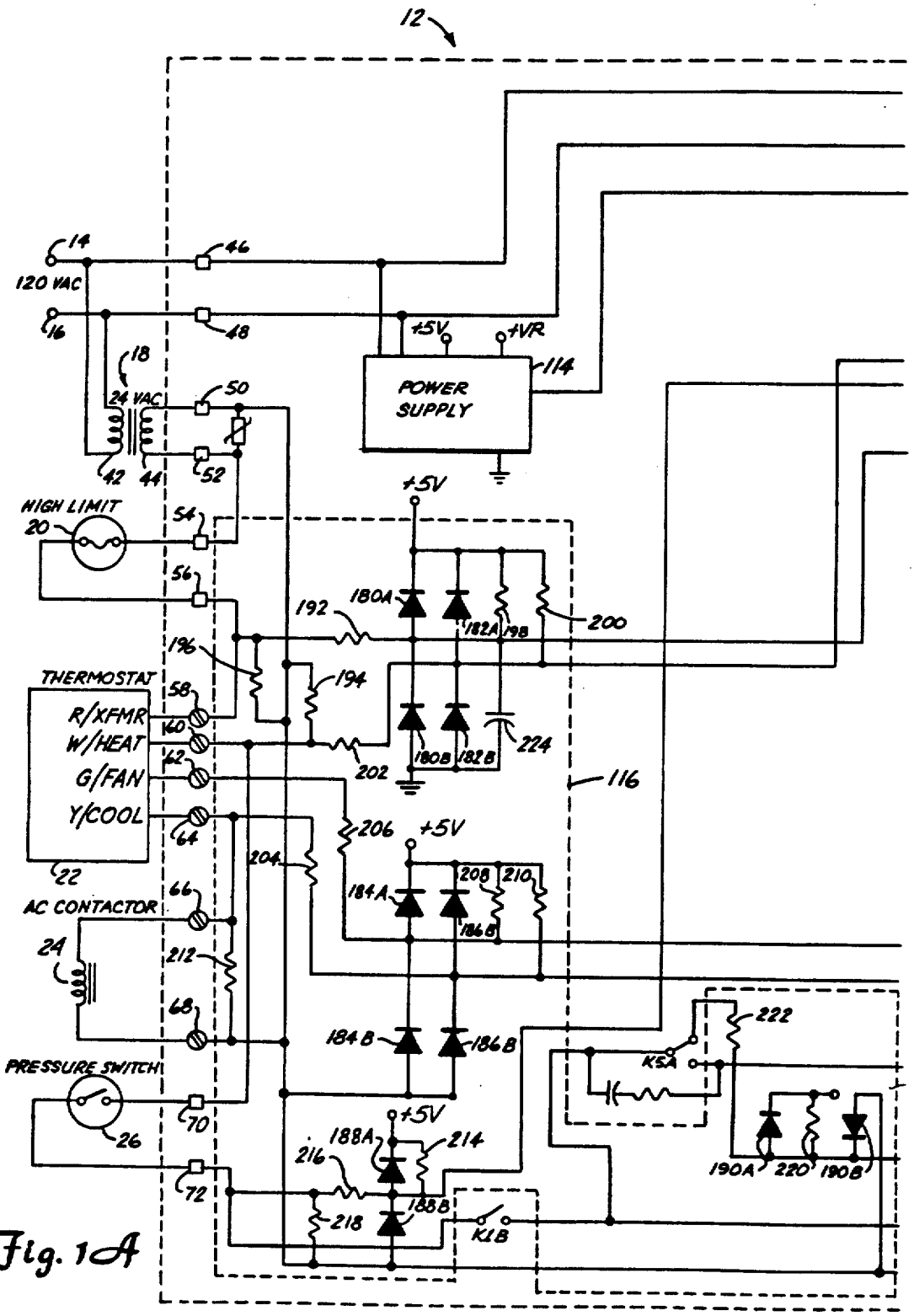
FIGS. 1A-1C together show an electrical schematic circuit diagram of a control system for a forced combustion air heating appliance, which includes the ignition controller of the present invention.
Figure 1B:
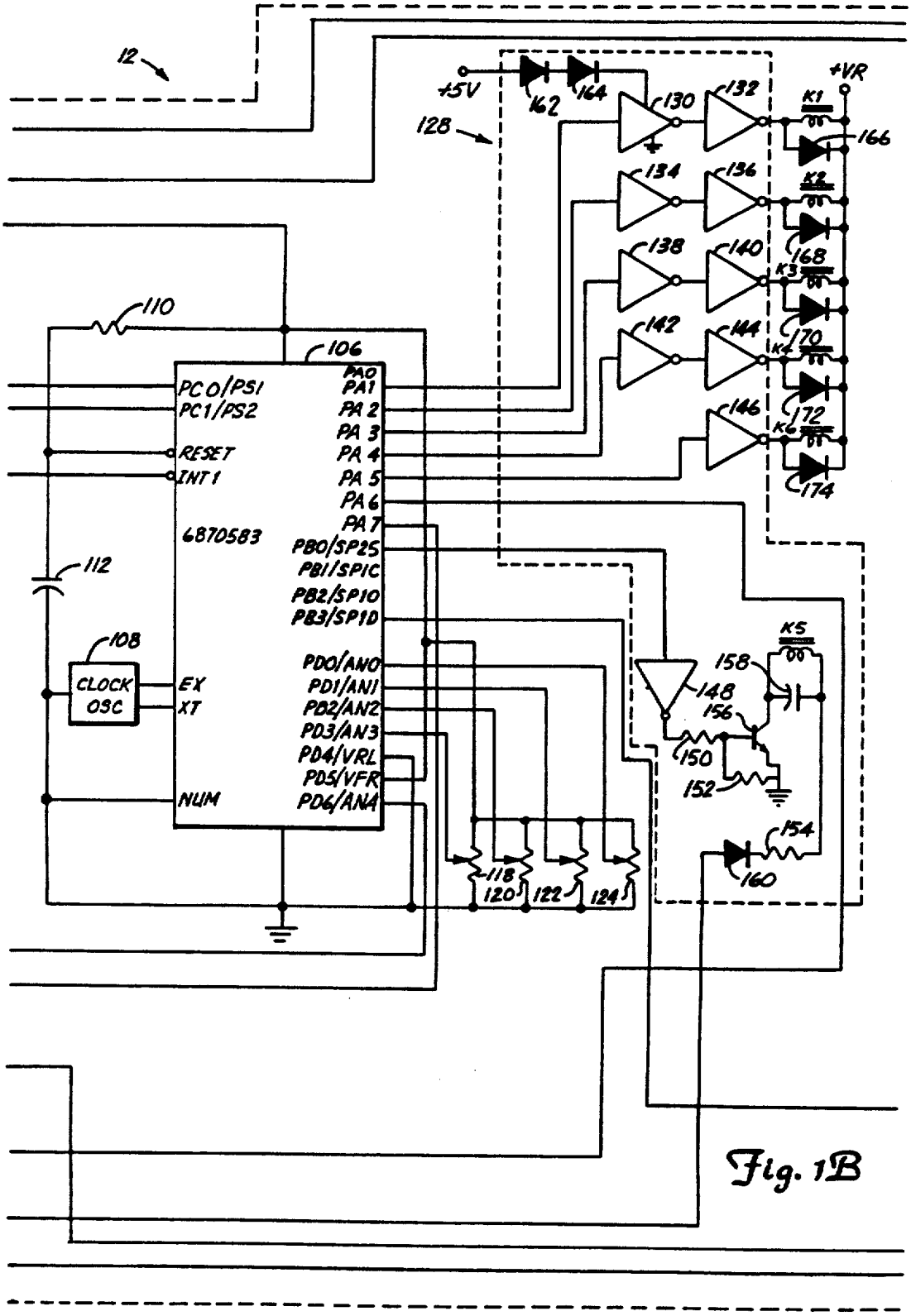
Figure 1C:
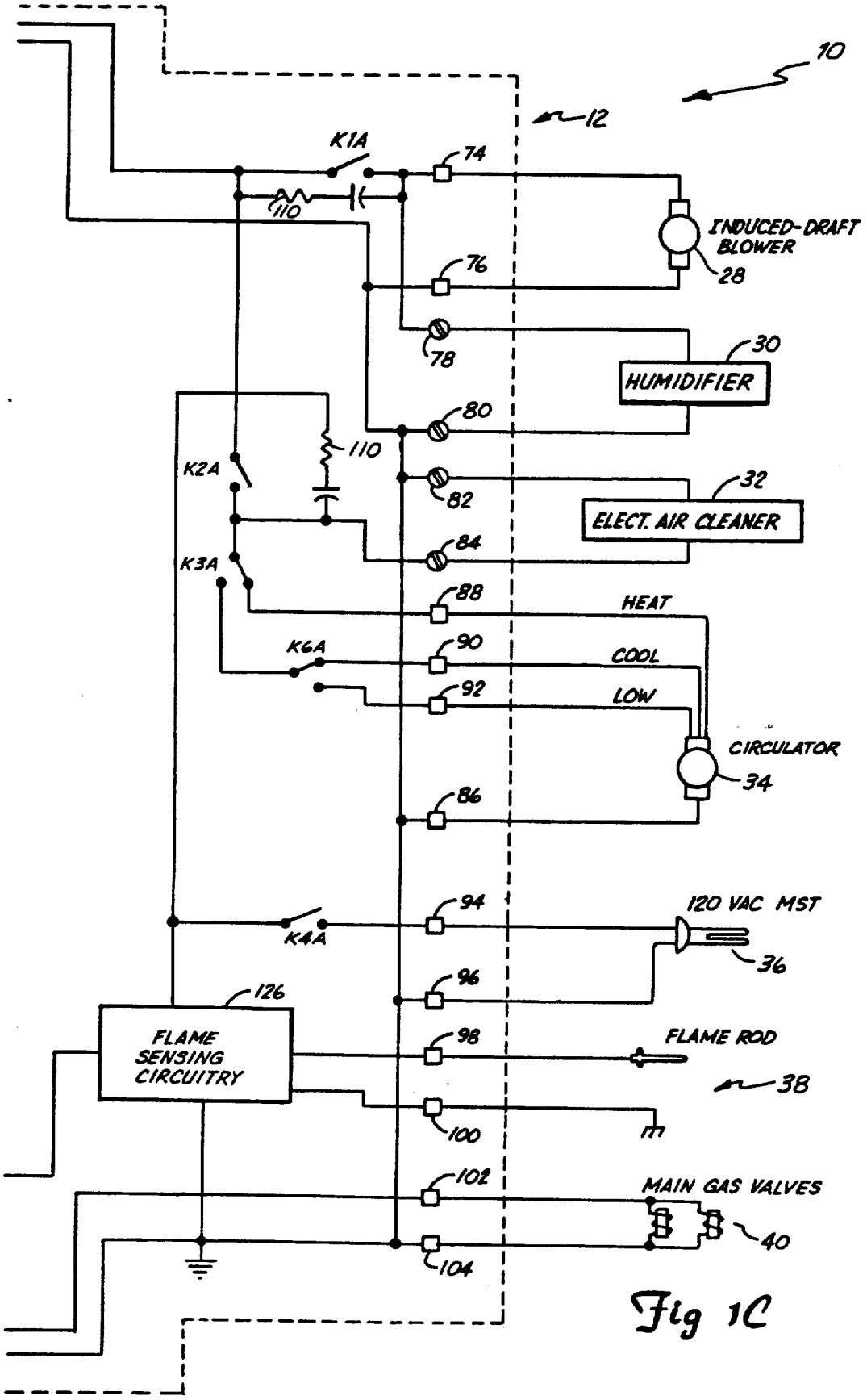

Heating and air conditioning control system 10 shown in FIGS. 1A-1C includes ignition controller 12, a pair of AC power terminals 14 and 16, stepdown transformer 18, high limit thermal switch 20, thermostat 22, air conditioning contactor 24, combustion air proving pressure switch 26, induced- draft combustion air blower 28, humidifier 30, electrostatic air cleaner 32, circulator fan motor 34, hot surface igniter 36, flame rod 38, and main gas valves 40. Control system 10 is preferably used for a gas-fired central heating furnace which may, for example, be used in a typical residence. The furnace is a high-efficiency type of furnace using induced-draft forced combustion air (provided by induced blower 28) and features electronic ignition (through hot surface igniter 36).

Control system 10 is powered by single phase 120 volt, 60 Hz AC voltage which is received at power terminals 14 and 16. Stepdown transformer 18 has its primary winding 42 connected to terminals 14 and 16 and its secondary winding 44 connected to ignition controller 12 to provide a source of 24 volt, 60 Hz, AC voltage. High limit switch 20, thermostat 22, AC contactor 24, pressure switch 26, and gas valves 40 operate on 24 volt AC power under the control of ignition controller 12. Induced-draft blower 28, humidifier 30, electrostatic air cleaner 32, circulator fan 34, hot surface igniter 36 and flame rod 38 all operate on 120 volt power provided through ignition controller 12.

Ignition controller 12 has a pair of power terminals 46 and 48, which are connected to line voltage terminals 14 and 16, and a pair of low voltage terminals 50 and 52 which are connected to secondary winding 44 of step-down transformer 18. Terminals 54 and 56 are connected to opposite sides of high limit switch 20. Terminals 58, 60, 62, and 64 are connected to thermostat 22. Typically, thermostat 22 has four wires, as shown in FIG. 1A. The "red" or "transformer" wire is connected to terminal 58, the "white" or "heat demand" wire is connected to terminal 60, the "green" or "fan" wire is connected to terminal 62, and the "yellow" or "cool demand" wire is connected to terminal 64.

Terminals 66 and 68 of controller 12 are connected to air conditioning contactor 24. When 24 volts AC power is present between terminals 66 and 68, air conditioning contactor 24 is energized, thereby turning on an air conditioning unit (not shown).

Combustion air proving pressure switch 26 is connected between terminals 70 and 72 of ignition controller 12. As shown in FIG. 1A, pressure switch 26 has a single pole normally open contact configuration, and will close when sufficient combustion air pressure is present.

As shown in FIG. 1C, terminals 74 and 76 of controller 12 are connected to induced-draft combustion air blower 28. Humidifier 30 is connected to terminals 78 and 80; and electrostatic air cleaner 32 is connected to terminals 82 and 84. Circular fan 34 is a tapped winding induction motor having a common connection to terminal 86 and having separate heat, cool, and low speed taps connected to terminals 88, 90 and 92, respectively. Hot surface igniter 36 is connected to terminals 94 and 96. Flame rod 38 is connected to terminal 98, and a ground connection is made to terminal 100. Finally, terminals 102 and 104 are connected to provide power to main gas valves 40.

Operation of ignition controller 12 is controlled by microprocessor 106 (shown in FIG. 1B), which in a preferred embodiment is a 6870583 microprocessor having on-board random access memory (RAM) and read only memory (ROM) and an analog-to-digital (A/D) converter. Clock oscillator circuit 108 provides the clock signal used for operation of microprocessor 106. Resistor 110 and capacitor 112 are connected to the reset terminal of microprocessor 106 to provide a reset signal after power loss.

Power supply circuit 114 is connected to power input terminals 46 and 48. The plus 5 volt and ground supply potentials required by microprocessor 106 are provided by power supply circuit 114. In addition, a higher DC voltage + VR required to operate relays is provided by power supply circuit 114.

Signal conditioning circuitry 116 provides inputs at the PCO/PS1, PC1/PS2, INT1, PD6/AN4, PA6 and PA7 ports of microprocessor 106. In each case, the signals from signal conditioning circuitry 116 are square wave 60 Hz signals which indicate the status of various components of system 10. In particular, the signal at the PCO/PS1 port indicates the status of the heat demand contacts of thermostat 22. The signal at the PC1/PS2 port indicates the status of pressure switch 26. The signal at the INT1 port indicates the status of high limit switch 20. The signal at the PD6/AN4 port indicates the status of the fan control contacts of thermostat 22. The signal at the PA6 port indicates the status of relay contacts K5A of the gas valve control relay. The signal at the PA7 port indicates the status of the cool demand contacts of thermostat 22.

Microprocessor 106 also receives analog inputs from four potentiometers 118, 120, 122, and 124 at its four analog inputs ANO-AN3 to its on-board A/D converter. The settings of potentiometers 118, 120, 122, and 124 set parameters used by microprocessor 106 in the operation of ignition controller 112. In particular, potentiometer 118 selects a circulator fan on-time time delay of between 15 to 90 seconds, and potentiometer 120 selects a circulator fan off-time delay of between 30 to 180 seconds. Potentiometers 122 and 124 are used together to set an ignition time, as is described in more detail in my copending patent application entitled "SAFETY-RELATED PARAMETER INPUTS FOR MICROPROCESSOR IGNITION CONTROLLER".

Microprocessor 106 also receives a flame signal from flame sensing circuitry 126, which is connected to terminals 98 and 100. The status of the signal at the PB3/SPID port of microprocessor 106 indicates whether a flame has been sensed by flame rod 38.

The outputs of microprocessor 106 are supplied at ports PA1-PA5 and PBO, and are provided to relay driver circuitry 128 to control energization of six relay coils K1-K6.

When relay coil K1 is energized, it closes normally open relay contacts K1A, which provides power to induced-draft blower 28 and humidifier 30. It also closes normally open relay contacts K1B, which are connected between pressure switch 26 and gas valve control relay contacts K5A.

When coil K2 is energized, it closes normally open relay contacts K2A, which provides power to electrostatic air cleaner 32 and to circulator fan motor 34.

Relay coils K3 and K6 are used to select the particular tapped winding of circulator fan 34. Relay contacts K3A have a normally closed contact connected to terminal 88 and a normally open contact connected to contacts K6A. The normally closed contact of K6A is connected to terminal 90, and the normally open contact is connected to terminal 92. As described in further detail in my copending patent application entitled "SPEED CONTROL FOR MULTITAP INDUCTION MOTOR", the energization of relay coils K2, K3, and K6 is coordinated by microprocessor 106 so that relay contacts K3A and K6A change state (to change motor speed) only when contacts K2A are open. This avoids the possibility of relay contact welding of the normally closed contacts of relays K3A and K6A.

Relay coil K4, when energized, closes contacts K4A. This provides 120 volt AC power to hot surface igniter 36.

Relay coil K5 controls contacts K5A, which include a normally closed and a normally open contact. The normally open contact is connected to main gas valves 40. The normally closed contact is connected to signal conditioning circuitry 116. When coil K5 is energized, relay contacts K5A change state to permit power to be applied to the main gas valves 40 through terminals 102 and 104.

In the preferred embodiment shown in FIG. 1B, the drive circuitry 128 includes inverters 130, 132, 134, 136, 138, 140, 142, 144, 146, and 148; resistors 150, 152, and 154; transistor 156; capacitor 158; and diodes 160, 162 and 164. Relay coils K1-K4 are each driven through a pair of inverters. K1 is driven from port PA1 through inverters 130 and 132. K2 is driven from port PA2 through inverters 134 and 136. K3 is driven through inverters 138 and 140 from port PA3, and K4 is driven from port PA4 through inverters 142 and 144. Diode 166 is connected across coil K1, diode 168 is connected across coil K2, diode 170 is connected across coil K3 and diode 172 is connected across coil K4.

Microprocessor 106 drives coil K6 through a single inverter 146 from port PA5. Diode 174 is connected across coil K6.

The drive circuitry for coil K5 is different from that provided for the other coils K1-K4 and K6. Energization for coil K5 comes, on one terminal, from input terminal 72 through contacts K1B, diode 160, and resistor 154. Microprocessor 106 controls the other terminal of K5 through port PBO, inverter 148, resistors 150 and 152, and transistor 156. Thus, only if transistor 156 is turned on and power is present at input terminal 72 (and contacts K1B are closed) will it be possible for relay K5 to be energized.

In the preferred embodiment shown in FIG. 1A, signal conditioning circuitry 116 includes six pairs of diodes 180A, 180B; 182A, 182B; 184A, 184B; 186A, 186B; 188A, 188B; and 190A, 190B connected between +5 V and ground. Signal conditioning circuitry 116 also includes resistors 192, 194, 196, 198, 200, 202, 204, 206, 208, 210, 212, 214, 216, 218, 220, and 222 and capacitor 224. One of the input ports of microprocessor 106 is connected to the junction or connection node of each diode pair. For example, port INT1 of microprocessor 106 is connected to the node at which the anode of diode 180A and the cathode of 180B are connected. Each pair of diodes, therefore, rectifies the 24 volt AC voltage it receives to produce an essentially square wave 60 Hz signal which switches between approximately one diode drop (0.7 V) above +5 V and approximately one diode drop (0.7 V) below ground. The input signals to microprocessor 106 from signal conditioning circuitry 116, therefore are AC signals, rather than DC logic levels. This provides greater protection against failure or malfunction because microprocessor 106 looks for a continuously changing signal rather than a DC level.

Before describing the safety features provided by the present invention, review of the normal operating sequence of system 10 will be helpful. In this description, it will be assumed that thermostat 22 is set to control heating, which will be signalled by closing contacts connected between terminals 58 and 60 to indicate a heat demand. In this initial condition, high limit thermal switch 20 is closed, pressure switch 26 is open, and all relay coils K1-K6 are turned off.

If high limit thermal switch 20 is open, or if there is a failure of resistor 192, diodes 180A or 180B, or of the input pin at port INT1, microprocessor 106 will not sense a 60 Hz squarewave at port INT1. Since the 60 Hz square wave must be present at port INT1 to prove that high limit thermal switch 20 is closed, microprocessor 106 will prohibit the ignition sequence from starting.

Microprocessor 106 monitors the status of the heat demand contacts of thermostat 22 at port PCO/PS1. If the heat demand contacts are open, or if resistor 202, diode 182A or diode 182B fails, the 60 Hz squarewave input will not be present. Because a valid thermostat heat request is not present, microprocessor 106 will not attempt an ignition sequence.

When thermostat 22 signals a heat demand by closing the heat demand contacts to connect terminals 58 and 60 together, 24 volt AC power is supplied from terminal 52 through terminal 54, through high limit switch 20 to terminal 56, to terminal 58, and then through the heat demand contacts of thermostat 22 to terminal 60. This supplies 24 volt AC power at terminal 60 to signal conditioning circuitry 116 and also to terminal 70 (which is connected to pressure switch 26). Microprocessor 106, upon sensing the presence of a squarewave signal at its PCO/PS1 port indicating a heat demand, then checks the status of pressure switch 26 by checking the signal at port PC1/PS2. At that point, pressure switch 26 should be open, and no squarewave signal should be present at PC1/PS2. If that is the case, microprocessor 106 provides an output signal to energize relay K1 and close contacts K1A and K1B. The closure of contacts K1A turns on induced-draft blower 28 and humidifier 30, while the closure of K1B provides a path for 24 volt power from terminal 72 to coil K5 and to contacts K5A.

Once induced-draft blower 28 is operating, pressure switch 26 should close. Upon switch closure, a squarewave signal will then be present at port PC1/PS2 of microprocessor 106. Microprocessor 106 then checks the status of the normally closed contacts of K5A by checking the signal at port PA6. If the system is operating properly and contacts K5A have not welded so that the normally open contact is closed, a signal should then be present at port PA6 in the form of a squarewave 60 Hz signal.

Microprocessor 106 will turn on coil K4 to supply power to the hot surface igniter 36. There is then a pre-heating time delay to allow the igniter to reach gas ignition temperature. Microprocessor 106 will then provide an output signal from its PBO port to turn on relay coil K5, to thus supply power to main gas valves 40.

An ignition trial time delay, selected by potentiometers 122 and 124, is started during which time the microprocesssor 106 monitors flame sensing circuitry 126 at its PB3 port. If system 10 is functioning properly, a flame will be established and sensed by flame rod 38 during the trial time. Upon establishment of a proper flame signal, power to relay coil K4 is turned off and a circulator fan on time delay, selected by potentiometer 118, is started. When the time delay is completed, the microprocessor will also turn on coil K2 to supply power to circulator fan 34 and electrostatic air cleaner 32. In this particular case, coils K3 and K6 can remain de-energized, because contacts K3A have selected the heat speed for circulator fan 34. Operation will then continue until the heat demand of thermostat 22 has been satisfied and heat demand contacts of thermostat 22 open to remove power from pressure switch 26, relay coil K5, and main gas valves 40.

Ignition controller 12 provides a series of safety-related checks which are used to detect first order safety-related failures. When such a failure is detected, controller 12 shuts down or inhibits the ignition sequence.

Before any ignition sequences can be initiated, microprocessor 106 must sense a 60 Hz squarewave on port INT1 to indicate that thermal high limit switch 20 is closed. If diodes 180A or 180B, resistor 192, or the pin at port INT1 fails, the 60 Hz squarewave will not be present, which is indication of an open limit contact.

Microprocessor 106 responds to an open limit by inhibiting any ignition sequence and turning on the output for circulator fan relay coil K2.

If the contacts of pressure switch 26 are welded closed, then upon closure of the heat demand contacts of thermostat 22, microprocessor 106 will sense a squarewave signal at its PC1/PS2 port before it has turned on induced-draft blower 28. This indicates a malfunction of pressure switch 26 and causes the ignition sequence to be halted.

If the diodes 188A or 188B, resistor 216, or the pin at port PC1/PS2 fails, microprocessor 106 will not sense a 60 Hz squarewave input after powering relay K1 to turn on induced-draft blower 28. This will halt the ignition sequence, just as will the failure of pressure switch 26 to close after induced-draft blower 28 has started.

After pressure switch 26 closure has been sensed by microprocessor 106, a signal should be present as well at port PA6 if contacts K5 are functioning properly. If contacts K5A fail, or if any of the components such as resistor 222 or diodes 90A, 190B, or the pin at port PA6 fail, the 60 Hz squarewave will not be present. Failure of this check causes immediate shutdown, with all outputs of microprocessor 106 turned off. As a result, relay coil K1 is deenergized so that induced-draft blower 28 will be turned off and contacts K1B are opened. Since pressure switch 26 has previously been proved to be operational, the turning off of induced-draft blower 28 gives microprocessor 106 an ability to break the energization circuit to main gas valve 40 (through pressure switch 26) in the event of a malfunction of relay contacts K5A. In addition, the opening of contacts K1B when K1 is deenergized will break the energization circuit to contacts K5A.

If relay coil K1 or contacts K1A or the associated output pin of microprocessor 106 and the driver circuitry 128 fail so that contacts K1A are always closed, microprocessor 106 will halt the ignition sequence immediately after receiving a thermostat heat request. This happens because of the "safe start" contact position check which is performed by microprocessor 106 on pressure switch 26 before powering induced-draft blower 28. If a 60 Hz squarewave input is seen at port PC1/PS2 before microprocessor 106 has turned on port PA1 to turn on relay K1, this means that pressure switch 26 is already closed when it should not be. Microprocessor 106 halts further operation and turns off all outputs and will not allow the ignition sequence to continue.

If relay K1 (or its associated driver circuitry) fails so that contacts K1A cannot be closed, microprocessor 106 halts the ignition sequence after attempting to power induced-draft blower 28. This happens because a 60 Hz squarewave must be seen which indicates closure of pressure switch 26. If pressure switch 26 does not close after microprocessor 106 has attempted to turn on induced-draft blower 28, a failure condition is indicated and microprocessor 106 halts the ignition sequence.

If relay K5, or the associated output pin of microprocessor 106, or the driver circuitry used to drive relay K5 fails so that the normally closed contacts of K5A are held open, microprocessor 106 determines that the "safe start" check on gas valve control relay contacts K5A have failed. This check looks for the 60 Hz squarewave on input port PA6 immediately after pressure switch 26 is detected as closed and before microprocessor 106 has powered relay K5. Failure of this check causes immediate shutdown, with all outputs turned off.

If relay K5, or the associated output pin and driver circuitry, fails so that the normally open contacts of K5A cannot close, microprocessor 106 will not be able to power gas valve 40. This will cause ignition lockout because it will not be possible to establish flame in the gas burner (as detected by flame rod 38) during the ignition trial time.

If relay K4 or the associated output pin of microprocessor 106 and driver circuitry fails, there is no safety issue. Hot surface igniter 36 is always on, so it will have a shorter life, but it cannot cause a safety problem since the gas valve is under safety control. If hot surface igniter 36 cannot turn on, microprocessor 106 will determine that there is a failure because of the lack of a sensed flame during the ignition trial period. This will result in a lockout of the ignition sequence by microprocessor 106.

Microprocessor 106 also detects failures of flame rod 38 and flame sensing circuitry 126. If either fails in such a way that a "false" flame signal is produced, microprocessor 106 will determine this condition because it is constantly monitoring the flame signal at its PB3 port. The existence of a flame signal at any time prior to an ignition trial will indicate a malfunction, and will result in a shutdown of the system by microprocessor 106. The failure to produce a flame signal (due to any cause including malfunction of flame rod 38 or flame sensing circuitry 126) will result in an ignition sequence lockout by microprocessor 106.

The control system of the present invention has a number of important advantages over prior art ignition control systems. First, the present invention provides for detection of safety critical component failures on a first order level. This includes not only the devices themselves, but also signal processing components (and even input pins of microprocessor 106).

Second, the present invention allows detection of welding contact failures of safety critical components such as pressure switch 26, and gas valve control relay contacts K5A. Although present safety requirements do not require checking these contacts if they pass load cycling life tests, the present invention provides an inherently safer control even if these components are subjected to much longer life than that for which they were tested.

Third, the present invention provides a low cost method of monitoring various signals in the 24 volt circuit in a way which is compatible with a digital control system and a microprocessor.

Fourth, by using squarewave AC signals, rather than fixed DC levels, component failures can be detected to a much greater extent than previously has been the practice.

Although the present invention has been described with reference to preferred embodiments, workers skilled in the art will recognize that changes may be made in form and detail without departing from the spirit and scope of the invention.

What is claimed is:

1. In a control system for a gas-fired forced combustion air heating appliance which includes a combustion air blower, a gas valve, a thermostat, a combustion air pressure switch, and a combustion air blower control relay, an improvement comprising:

an energization circuit for the gas valve which includes a serial energization path through the thermostat and the combustion air pressure switch;

means for providing a first signal having a waveform indicative of status of the thermostat;

means for providing a second signal having a waveform indicative of status of the combustion air pressure switch;

a gas valve control relay having normally open gas valve relay contacts connected in the energization path and having a gas valve relay coil connected to the energization path at a first point between the combustion air pressure switch and the gas valve relay contacts;

means for providing a third signal having a waveform indicative of status of the gas valve control relay; and controller means for controlling operation of the combustion air blower through the combustion air blower control relay and the gas valve through the gas valve control relay as a function of the first, second and third signals, the controller means generating a relay control signal which energizes the gas valve relay coil only when electrical power is supplied to the gas valve relay coil through the thermostat and the combustion air pressure switch.

2. The improvement of claim 1 wherein the controller means causes the gas valve to be turned off if the second signal indicates that the combustion air pressure switch is sensing that the combustion air blower is on when the means for controlling has not turned on the combustion air blower.

3. The improvement of claim 1 wherein the blower control relay includes first blower relay contacts for controlling energization of the combustion air blower and includes second blower relay contacts connected in the serial energization path at a point between the combustion air pressure switch and the gas valve relay coil and wherein the controller means opens the first and second blower relay contacts to turn off the combustion air blower and to prevent energization of the gas valve if the third signal indicates that the gas valve control relay is closed before the means for controlling has provided a signal to the gas valve control relay to cause it to close.

4. The improvement of claim 1 wherein the controller means provides a signal to the combustion air blower control relay to cause the combustion air blower to turn on in response to the first signal indicating that the thermostat requires heat.

5. The improvement of claim 4 wherein the controller means inhibits further operation of the combustion air blower and the gas valve if the second signal does not indicate a closure of the combustion air pressure switch within a predetermined time after the means for controlling has provided the signal to the combustion air blower control relay.

6. The improvement of claim 1 and further comprising:

a high limit thermal switch connected in the serial energization path; and means for providing a fourth signal to the controller means which has a waveform indicative of status of the high limit thermal switch.

7. The improvement of claim 1 wherein the combustion air blower relay has a first pair of normally open blower relay contacts for controlling energization of the combustion air blower and has a second pair of normally open blower relay contacts connected in the serial energization path at a second point between the combustion air pressure switch and the gas valve relay contacts.

8. The improvement of claim 1 wherein the gas valve control relay further includes normally closed relay contacts connected between the serial energization path and the means for providing a third signal.

9. The improvement of claim 1 wherein the energization circuit is connected to a source of alternating current power.

10. The improvement of claim 9 wherein the source of alternating current power is a secondary winding of a step down transformer.

11. The improvement of claim 1 and further comprising:

igniter means, controlled by the controller means, for igniting a gas/air mixture in the heating appliance; and flame sensing means for sensing a flame in the heating appliance and providing a flame sensor signal to the controller means which indicates presence of the flame.

12. The improvement of claim 11 wherein the controller means inhibits further operation of the combustion air blower and the gas valve if the flame signal is not received within a predetermined time period after the igniter means is turned on by the controller means.

13. A control system for a gas-fired combustion air heating appliance of the type having a combustion air blower and a gas valve, the control system comprising:

thermostat means for sensing temperature, the thermostat means having heat demand contacts which close when the thermostat means requires heat;

combustion air pressure switch means for sensing when combustion air is being delivered by the combustion air blower, wherein the heat demand contacts, the combustion air pressure switch means and the gas valve are connected in a serial gas valve energization path;

combustion air blower control relay means for controlling operation of the combustion air blower, the combustion air blower control relay means having a coil and first normally open contacts connected to the combustion air blower;

gas valve control relay means having a gas valve relay coil connected to the serial gas valve energization path, and having normally open gas valve relay contacts connected in the serial gas valve energization path between the gas valve relay coil and the gas valve so that the gas valve relay coil can energize and close the gas valve relay contacts only when the heat demand contacts and t he combustion air pressure switch means are closed; and controller means for controlling energization of the coils of the combustion air blower control relay means and the gas valve control relay means as a function of periodically alternating status signals indicative, by their presence or absence, of status of the heat demand contacts, the combustion air pressure switch means, and the normally open contacts of the gas valve control relay means to inhibit energization of the coils of the combustion air blower control relay means and the gas valve control relay means if the combustion air pressure switch means is closed when the combustion air blower is off.

14. The control system of claim 13 wherein the controller means turns off the combustion air blower control relay means and thereby causes the energization path to open if the normally open contacts of the gas valve control relay means are closed when the combustion air pressure switch means is closed and the coil of the gas valve control relay means is not energized.

15. The control system of claim 14 wherein the gas valve control relay means includes normally closed contacts associated with its normally open contacts, and wherein the controller means monitors status of the normally closed contacts of the gas valve control relay means to determine whether the normally open contacts of the gas valve control relay means are closed.

16. The control system of claim 13 wherein the gas valve relay coil is connected between the serial gas valve energization path and the controller means so that the gas valve relay coil can be energized only if the heat demand contacts and the combustion air pressure switch means are closed and the controller means provides a signal which causes the coil of the gas valve control relay means to be energized.

17. The control system of claim 13 wherein the combustion air blower control relay means further includes second normally open contacts connected in the serial gas valve energization path.

18. A control system for a gas-fired combustion air heating appliance of the type having a combustion air blower and a gas valve, the control comprising:

thermostat means for sensing temperature, the thermostat means having heat demand contacts which close when the thermostat means requires heat;

combustion air pressure switch means for sensing when combustion air is being delivered by the combustion air blower;

combustion air blower control relay means for controlling operation of the combustion air blower, the combustion air blower control relay means having a coil, first normally open contacts connected to the combustion air blower and second normally open contacts connected in a serial gas valve energization path with the heat demand contacts, the combustion air pressure switch and the gas valve;

gas valve control relay means for controlling operation of the gas valve, the gas valve control relay means having a coil connected to the serial gas valve energization path, and having normally open contacts connected in the path so that the coil of the gas valve control relay means is energized only when the heat demand contacts and the combustion air pressure switch means are closed; and controller means for controlling energization of the coils of the combustion air blower control relay means and the gas valve control relay means as a function of periodically alternating status signals indicative, by their presence or absence, of status of the heat demand contacts, the combustion air pressure switch means, and the normally open contacts of the gas valve control relay means to open the second normally open contacts of the combustion air blower control relay means and thereby cause the serial gas valve energization path to open if the normally open contacts of the gas valve control relay means are closed when the combustion air pressure switch means is closed and the coil of the gas valve control relay means is not energized.

19. The control system of claim 18 wherein the gas valve control relay means includes normally closed contacts associated with its normally open contacts, and wherein the controller means monitors status of the normally closed contacts of the gas valve control relay means to determine whether the normally open contacts of the gas valve control relay means are closed.

20. In a control system for a gas-fired forced combustion air heating appliance which includes a combustion air blower, a gas valve, a thermostat, a combustion air pressure switch, a combustion air blower control relay and a gas valve control relay with a gas valve relay coil and gas valve relay contacts, and improvement comprising:

an energization circuit for the gas valve which includes a series of connection of the thermostat, the combustion air pressure switch and the gas valve relay contacts;

first means for providing a first periodically alternating signal, which indicates, by its presence, status of the thermostat;

second means for providing a second periodically alternating signal which indicates, by its presence, status of the combustion air pressure switch;

third means for providing a third periodically alternating signal which indicates, by its presence, status of the gas valve relay contacts;

controller means for controlling operation of the combustion air blower through the combustion air blower control relay and the gas valve through the gas vale control relay as a function of the first, second and third signals; and wherein the gas valve relay coil is connected between the controller means and the series connection at a point between the combustion air pressure switch and the gas vale relay contacts so that the gas valve relay coil can be energized only while electrical power is supplied through the series connection of the thermostat and the combustion air pressure switch.

21. The improvement of claim 20 wherein the controller means causes the gas valve to be turned off if the second signal is present when the means for controlling has not turned on the combustion air blower.

22. The improvement of claim 20 wherein the controller means causes the combustion air blower to be turned off if the third signal is not present before the means for controlling has provided a signal to the gas valve control relay to cause it to close.

23. The improvement of claim 20 wherein the controller means provides a signal to the combustion air blower control relay to cause the combustion air blower to turn on in response to presence of the first signal.

24. The improvement of claim 23 wherein the controller means inhibits further operation of the combustion air blower and the gas valve if the second signal is not present within a predetermined time after the means for controlling has provided the signal to the combustion air blower control relay.

25. The improvement of claim 20 and further comprising:

a high limit thermal switch connected in the energization circuit; and fourth means for providing a fourth periodically alternating signal to the controller means which indicates, by its presence, status of the high limit thermal switch.

26. The improvement of claim 20 wherein the gas valve control relay has normally open and normally closed relay contacts, and wherein the means for providing a third signal is connected to the normally closed relay contacts.

27. The improvement of claim 20 wherein the energization circuit is connected to a source of alternating current power.

28. The improvement of claim 27 wherein the source of alternating current is a secondary winding of a step down transformer.

29. The improvement of claim 28 wherein the first, second and third means convert alternating current power derived from the thermostat, the combustion air pressure switch and the gas valve control relay, respectively, to essentially square wave first, second and third signals.

* * * * *

UNITED STATES PATENT AND TRADEMARK OFFICE

CERTIFICATE OF CORRECTION

PATENT NO. : 5,074,780

DATED : December 24, 1991

INVENTOR(S) : John L. Erdman

It is certified that error appears in the above-identified patent and that said Letters Patent is hereby corrected as shown below:

Col. 10, line 51, delete "t he" and insert --the--.

Col. 12, line 8, delete "and" and insert --an--.

Col. 12, line 26, delete "vale" and insert --valve--

Col. 12, line 31, delete "vale" and insert --valve-

Signed and Sealed this

Thirtieth Day of March, 1993

*Attest:*

STEPHEN G. KUNIN

*Attesting Officer*

*Acting Commissioner of Patents and Trademarks*